US007481088B2

(12) United States Patent
Bayer et al.

(10) Patent No.: US 7,481,088 B2
(45) Date of Patent: Jan. 27, 2009

(54) METHOD AND DEVICE FOR SURFACE BLASTING GAS TURBINE BLADES IN THE AREA OF THE ROOTS THEREOF

(75) Inventors: Erwin Bayer, Dachau (DE); Thomas Peschke, Groebenzell (DE); Holger Polanetzki, Dachau (DE); Alexander Winkler, Karlsfeld (DE); Thomas Dautl, Weichs (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 11/630,052

(22) PCT Filed: Jun. 8, 2005

(86) PCT No.: PCT/DE2005/001022

§ 371 (c)(1),
(2), (4) Date: Feb. 15, 2007

(87) PCT Pub. No.: WO2005/123338

PCT Pub. Date: Dec. 29, 2005

(65) Prior Publication Data

US 2007/0214640 A1 Sep. 20, 2007

(30) Foreign Application Priority Data

Jun. 19, 2004 (DE) ..... 10 2004 029 546

(51) Int. Cl.
*B23P 15/00* (2006.01)
*C21D 7/06* (2006.01)
*B24B 1/04* (2006.01)

(52) U.S. Cl. ..... 72/53; 72/430; 29/90.7; 29/889.21; 29/889.22

(58) Field of Classification Search ..... 72/53, 72/430; 29/90.7, 899.21, 899.22, 889.2
See application file for complete search history.

(56) References Cited

U.S. PATENT DOCUMENTS

| | | | | |
|---|---|---|---|---|
| 3,668,912 | A | 6/1972 | Baughman et al. | |
| 3,668,913 | A | 6/1972 | Morris | |
| 3,695,091 | A | 10/1972 | Smith | |
| 4,115,076 | A | 9/1978 | Hitzrot, Jr. | |
| 4,350,035 | A | 9/1982 | Kopp et al. | |
| 4,694,672 | A | 9/1987 | Baughman | |
| 4,888,863 | A * | 12/1989 | Cox et al. | 29/889.7 |
| 4,974,434 | A | 12/1990 | Reccius et al. | |
| 5,085,747 | A | 2/1992 | Nikano | |
| 5,443,201 | A | 8/1995 | Cartry | |

(Continued)

FOREIGN PATENT DOCUMENTS

FR 2 815 280 4/2002

(Continued)

*Primary Examiner*—David B Jones
(74) *Attorney, Agent, or Firm*—W. F. Fasse; W. G. Fasse

(57) ABSTRACT

An apparatus for surface blasting gas turbine blades in the area of their blade roots includes a vibrator with an oscillating surface oriented so that the oscillating surface extends essentially in the horizontal direction. A processing chamber for receiving the blade root adjoins the oscillating surface. The processing chamber is embodied such that the turbine blade is orientable, during the blasting, with a profiled support surface of the blade root extending at least temporarily essentially parallel to the oscillating surface of the vibrator.

18 Claims, 4 Drawing Sheets

U.S. PATENT DOCUMENTS

| | | | | |
|---|---|---|---|---|
| 5,509,286 | A | 4/1996 | Coulon | |
| 5,596,912 | A | 1/1997 | Laurence et al. | |
| 5,771,729 | A | 6/1998 | Bailey et al. | |
| 5,820,011 | A | 10/1998 | Ito et al. | |
| 5,829,116 | A | 11/1998 | Vilon | |
| 5,950,470 | A | 9/1999 | Prewo et al. | |
| 6,170,308 | B1 | 1/2001 | Veronesi et al. | |
| 6,289,705 | B1 | 9/2001 | Duquenne et al. | |
| 6,336,844 | B1 | 1/2002 | Duquenne et al. | |
| 6,343,495 | B1 | 2/2002 | Cheppe et al. | |
| 6,467,321 | B2 | 10/2002 | Prokopenko et al. | |
| 6,490,899 | B2 * | 12/2002 | Berthelet et al. | 72/53 |
| 6,505,489 | B2 | 1/2003 | Berthelet et al. | |
| 6,508,093 | B2 | 1/2003 | Berthelet et al. | |
| 6,536,109 | B2 | 3/2003 | Berthelet et al. | |
| 6,584,820 | B1 | 7/2003 | Benedict et al. | |
| 6,938,448 | B2 | 9/2005 | Kennerknecht et al. | |
| 7,028,378 | B2 | 4/2006 | Cheppe et al. | |
| 7,140,216 | B2 * | 11/2006 | Garza | 72/53 |
| 7,181,944 | B2 | 2/2007 | Wuestefeld et al. | |
| 2002/0124402 | A1 | 9/2002 | Berthelet et al. | |
| 2003/0115922 | A1 | 6/2003 | Berthelet et al. | |
| 2006/0021410 | A1 * | 2/2006 | Cheppe et al. | 72/53 |
| 2006/0174483 | A1 * | 8/2006 | Bayer et al. | 29/889.2 |

FOREIGN PATENT DOCUMENTS

| | | |
|---|---|---|
| GB | 2 250 931 | 6/1992 |
| JP | 07-308859 | 11/1995 |

* cited by examiner

METHOD AND DEVICE FOR SURFACE BLASTING GAS TURBINE BLADES IN THE AREA OF THE ROOTS THEREOF

BACKGROUND INFORMATION

The invention relates to a method and an apparatus for the surface blasting, especially the ultrasonic shot peening, of gas turbine blades in the area of their blade roots.

Gas turbines, especially aircraft engines, have a rotor that is fitted with rotating rotor blades especially in the area of their compressor as well as their turbine, whereby the rotating rotor blades of the gas turbine are anchored via profiled blade roots in corresponding recesses of the gas turbine rotor. According to the state of the art, it is possible to profile the blade roots either according to the so-called fir tree design or according to the so-called dovetail design and to anchor the blade roots in correspondingly profiled recesses of the gas turbine rotor. The preferably fir tree profiled or dovetail profiled surfaces of a blade root of a gas turbine blade are also referred to as carrier or support surfaces.

During the operation of a gas turbine, the blade roots are strongly loaded or influenced especially by frictional wear on their profiled support surfaces. The wear rate in the area of the blade roots can be reduced in that the blade roots are hardened on their support surfaces by special surface treatment or processing methods. In this regard, preferably the shot peening is applied. In the conventional shot peening, a considerable surface roughening can arise on the support surfaces of the blade roots, whereby the fitting accuracy of the blade roots is negatively influenced or impaired.

In order to improve the treatment or processing quality arising during shot peening on blade roots of gas turbines that are to be processed, it is already known from the state of the art according to U.S. Pat. No. 6,536,109 B2, to harden the blade roots in the area of their profiled support surfaces by so-called ultrasonic shot peening. Thus, the U.S. Pat. No. 6,536,109 B2 discloses a corresponding apparatus with an ultrasonic sonotrode, whereby the ultrasonic sonotrode comprises a level or horizontally extending, vibrating or oscillating surface, and whereby a processing chamber extends above this oscillating surface. Gas turbine blades are arranged standing with their blade roots in the processing chamber for the processing thereof in the area of their support surfaces. In that regard, according to the U.S. Pat. No. 6,536,109 B2, the gas turbine blades to be processed are oriented standing in such a manner so that the profiled support surfaces of the blade roots that are to be processed extend essentially perpendicularly to the oscillating surface of the ultrasonic sonotrode. Herewith only an insufficient quality can be achieved in the shot peening of the profiled support surfaces of the blade roots.

SUMMARY OF THE INVENTION

Beginning from this, the problem underlying the present invention is to provide a novel method and a novel apparatus for the surface blasting, especially for the ultrasonic shot peening of gas turbine blades in the area of their blade roots.

This problem is solved by a method for the surface blasting, especially for the ultrasonic shot peening, of gas turbine blades in the area of their blade roots. According to the invention, the or each gas turbine blade is oriented for the surface blasting in such a manner so that during the surface blasting at least one profiled support surface, which is to be processed, of the or each blade root extends at least temporarily essentially parallel to an oscillating surface of the or each vibrator, especially the or each ultrasonic sonotrode, whereby the oscillating surface of the or each vibrator is oriented essentially in the horizontal or level direction.

In the sense of the present invention it is proposed, for the surface blasting, especially for the ultrasonic shot peening, to orient the gas turbine blades or rather the blade roots thereof in such a manner so that at least one support surface of the blade roots that is to be processed and that is preferably fir tree profiled or dovetail profiled, is oriented essentially parallel to the oscillating surface of the vibrator which extends in the horizontal direction. Thus, the gas turbine blades are positioned not standing as in the state of the art, but rather lying down in a processing chamber. Thereby the processing quality in the surface blasting of the support surfaces can be significantly improved in comparison to the state of the art.

According to a preferred further development of the invention, for the surface blasting, the or each gas turbine blade is rotated or turned about an axis extending essentially parallel to the oscillating surface of the or each vibrator, especially the or each ultrasonic sonotrode.

The inventive apparatus for the surface blasting, especially for the ultrasonic shot peening, of gas turbine blades in the area of their blade roots is configured and arranged as disclosed herein to carry out the inventive method.

BRIEF DESCRIPTION OF THE DRAWINGS

Example embodiments of the invention will be explained in further detail in connection with the drawing, without being limited thereto. In that regard.

DETAILED DESCRIPTION OF EXAMPLE EMBODIMENTS OF THE INVENTION

In the following, the present invention will be described in greater detail with reference to FIGS. 1 to 5.

Figure 1:
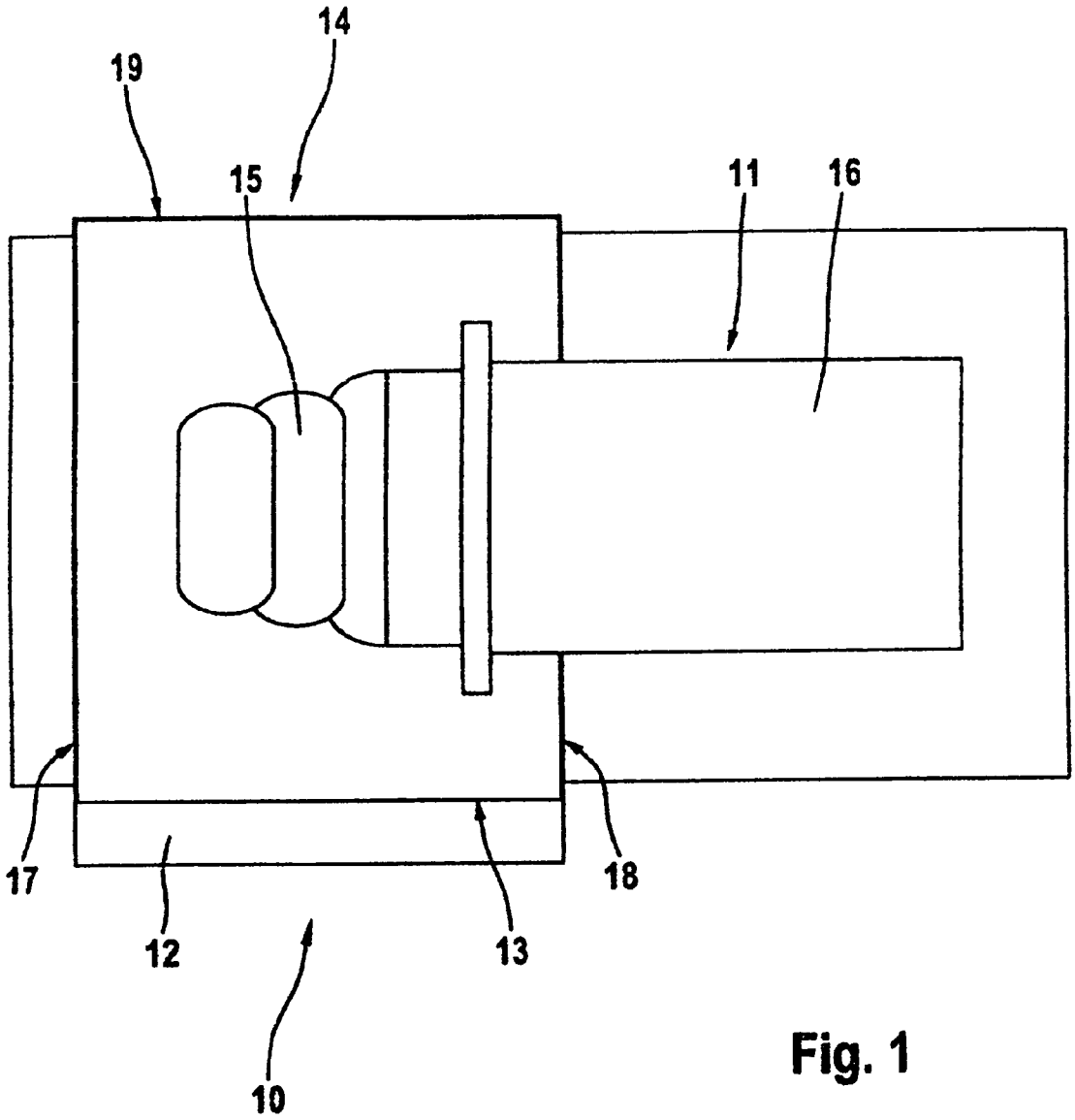
FIG. 1 shows a strongly schematized illustration of an inventive apparatus for the surface blasting, turbine blades in the area of their blade roots according to a first example embodiment of the invention.

FIG. 1 shows, in a strongly schematized manner, an inventive apparatus 10 for the ultrasonic shot peening of gas turbine blades in the area of their blade roots, together with a gas turbine blade 11. The inventive apparatus 10 has a vibrator embodied as an ultrasonic sonotrode 12 with a vibrating or oscillating surface 13 that extends essentially in the horizontal direction or the level direction. A treatment or processing chamber 14 is positioned above the oscillating surface 13 of the ultrasonic sonotrode 12, whereby a gas turbine blade 11 is arranged with its blade root 15 in the processing chamber 14 according to FIG. 1. The gas turbine blade 11, which is to be treated or processed in the area of the blade root 15, protrudes laterally or sideways with its blade vane 16 out of the processing chamber 14. As already mentioned, the processing chamber is bounded on its bottom side by the oscillating surface 13 of the ultrasonic sonotrode 12, and is bounded laterally as well as at the top by corresponding covers 17, 18 or 19. A plurality of shot particles or balls are positioned within the processing chamber 14, and are accelerated by the oscillating surface 13 of the ultrasonic sonotrode and are directed onto the blade root 15 of the gas turbine blade 11 that is to be processed. Under the influence of gravity the shot particles or balls again come into the area of the oscillating surface 13, in order to then once again be accelerated or moved in the direction toward the blade root 15 that is to be processed.

In the sense of the present invention, the gas turbine blade 11 positioned with the blade root 15 in the processing chamber 14 is oriented for the ultrasonic shot peening in such manner, so that during the blasting or peening at least one profiled support surface of the blade root 15 of the gas turbine blade 11 that is to be processed is oriented parallel to the level or horizontally extending oscillating surface 13 of the ultrasonic sonotrode 12. Accordingly, the gas turbine blade 11 lies within the processing chamber 14 in such a manner so that an axis extending from the radially inwardly lying end of the blade root 15 in a direction toward the radially outwardly lying end of the blade vane 16, does not extend upright or vertically, but rather horizontally or level, in contrast to the state of the art according to the U.S. Pat. No. 6,536,109 B2.

As caused or necessitated by the inventive orientation of the blade roots during the ultrasonic shot peening, the shot particles or balls accelerated by the ultrasonic sonotrode give off or transfer their impulse or momentum directly onto the support surfaces of the blade root that are to be hardened. Thereby, large hardening depths and compressive residual stresses can be achieved on the support surfaces of the blade root. Accordingly, there arises a direct hardening of the support surfaces of the blade roots that are to be blasted. Shorter processing times or blasting times can be realized than in the state of the art.

Since, during the blasting, the shot particles or balls are reflected at different angles from the covers 17, 18 and 19 of the processing chamber 14, just as from the oscillating surface 13 of the sonotrode 12, the shot particles or balls are not oriented in a preferred direction onto the support surfaces of the blade root 15 that are to be processed, but rather at various different angles. This achieves an efficient hardening of the support surfaces of the blade roots.

Figure 2:
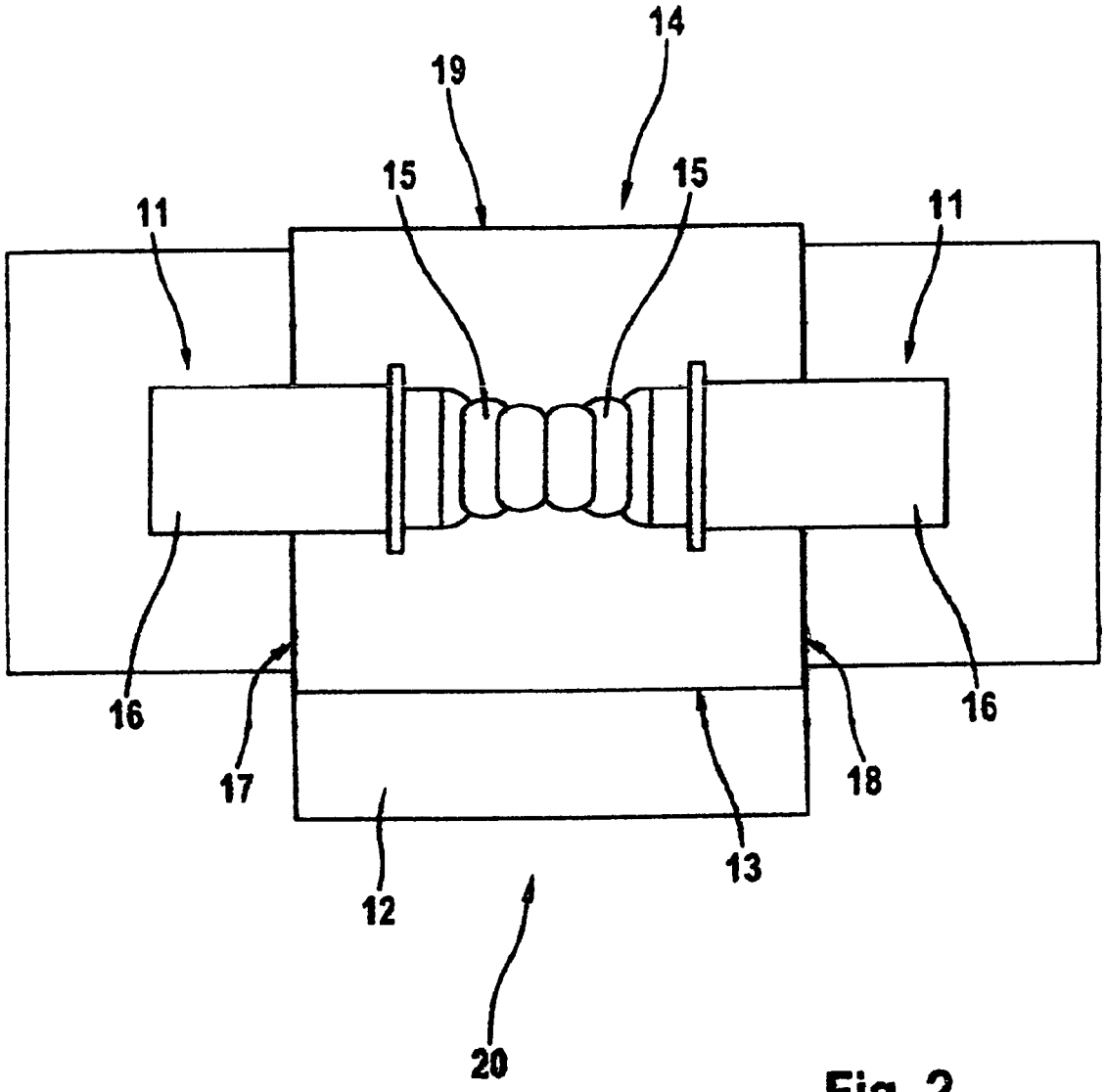
FIG. 2 shows a strongly schematized illustration of an inventive apparatus for the surface blasting, especially for the ultrasonic shot peening, of gas turbine blades in the area of their blade roots according to a second example embodiment of the invention.

In the example embodiment of FIG. 1, only one gas turbine blade 11 is positioned with the blade root, which is to be processed on the support surfaces, within the processing chamber 14. FIG. 2 shows an example embodiment of an inventive apparatus 20 for the shot peening of gas turbine blades in the area of their blade roots, whereby in the example embodiment of FIG. 2 two gas turbine blades 11 are positioned or oriented with their blade roots 15 in the processing chamber 14 of the apparatus 20 for the ultrasonic shot peening in the sense of the present invention, so that during the blasting, the support surface, which is to be blasted, of the blade roots 15 extends essentially parallel to the oscillating surface 13 of the ultrasonic sonotrode 12. With respect to the further details, however, the apparatus of FIG. 2 corresponds with the apparatus of FIG. 1, so that the same reference numbers are used for the same assemblies.

Figure 3:
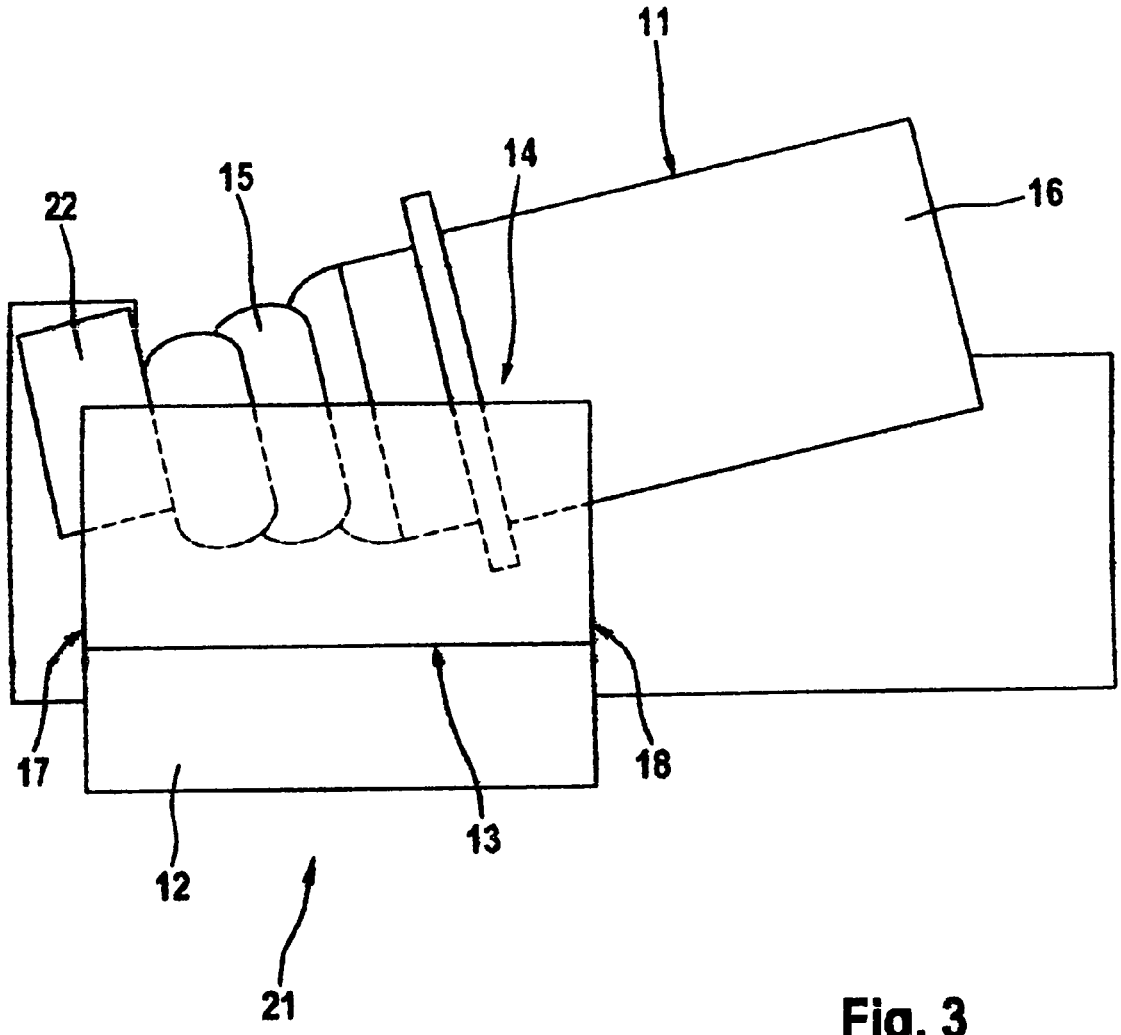
FIG. 3 shows a strongly schematized illustration of an inventive apparatus for the surface blasting, especially for the ultrasonic shot peening, of gas turbine blades in the area of their blade roots according to a third example embodiment of the invention.

FIG. 3 shows a further example embodiment of an inventive apparatus 21 for the shot peening of gas turbine blades in the area of their blade roots, whereby also in connection with the example embodiment of FIG. 3 the same reference numbers are used for the same assemblies in order to avoid unnecessary repetitions. The example embodiment of FIG. 3 differs from the example embodiment of FIG. 1 essentially in that the illustrated gas turbine blade 11 is oriented within the processing chamber 14 during the shot peening in such a manner relative to the oscillating surface 13 of the ultrasonic sonotrode 12, so that a tangent to projections of a support surface of the blade root 15 lying opposite the oscillating surface 13 extends essentially parallel to the oscillating surface 13 and thus essentially in the horizontal direction. For this purpose, the inventive apparatus 21 has an arrangement or device 22 for the tilting or pivoting of the gas turbine blade 11 within the processing chamber 14.

It is noted at this point, that in connection with the example embodiments according to FIGS. 1 to 3, during the ultrasonic shot peening, all illustrated gas turbine blades 11 can be turned or rotated about an axis that extends essentially parallel to the oscillating surface 13 of the ultrasonic sonotrode 12 and thus extends in the horizontal direction. The turning or rotating of the blade roots about this axis extending essentially in the horizontal direction can either be carried out continuously during the shot peening or intermittently or discontinuously. Thereby it is ensured that all of the support surfaces that are to be blasted are blasted uniformly by the shot particles or balls that are accelerated by the ultrasonic sonotrode 12.

FIGS. 4 and 5 show a further example embodiment of an inventive apparatus 23 for the shot peening of gas turbine blades in the area of their blade roots, whereby the apparatus 23 according to FIGS. 4 and 5 once again has an ultrasonic sonotrode 24 with an oscillating surface 25 that extends essentially in the horizontal or level direction. A processing chamber 26, which is shown strongly schematized in FIG. 5, is once again positioned above the oscillating surface 25 of the ultrasonic sonotrode 24. In the example embodiment of FIGS. 4 and 5, two gas turbine blades 11 are blasted in the area of their blade roots 15 within the processing chamber 26, whereby the gas turbine blades 11 are once again oriented for the ultrasonic shot peening in such a manner so that during the blasting at least one supporting surface of the blade roots 15, that is to be processed and that is especially fir tree profiled or dovetail profiled, extends at least temporarily essentially parallel to the oscillating surface 25 of the ultrasonic sonotrode 24 that extends in the horizontal direction.

Figure 4:
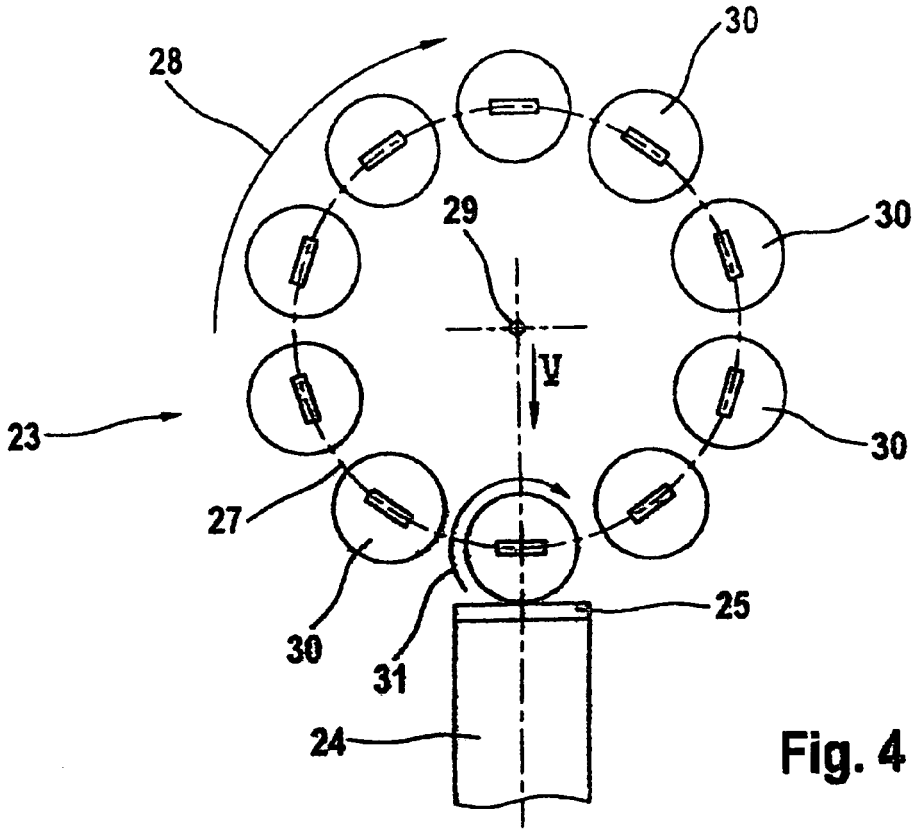
FIG. 4 shows a strongly schematized illustration of an inventive apparatus for the surface blasting, especially for the ultrasonic shot peening, of gas turbine blades in the area of their blade roots according to a further example embodiment of the invention.
Figure 5:
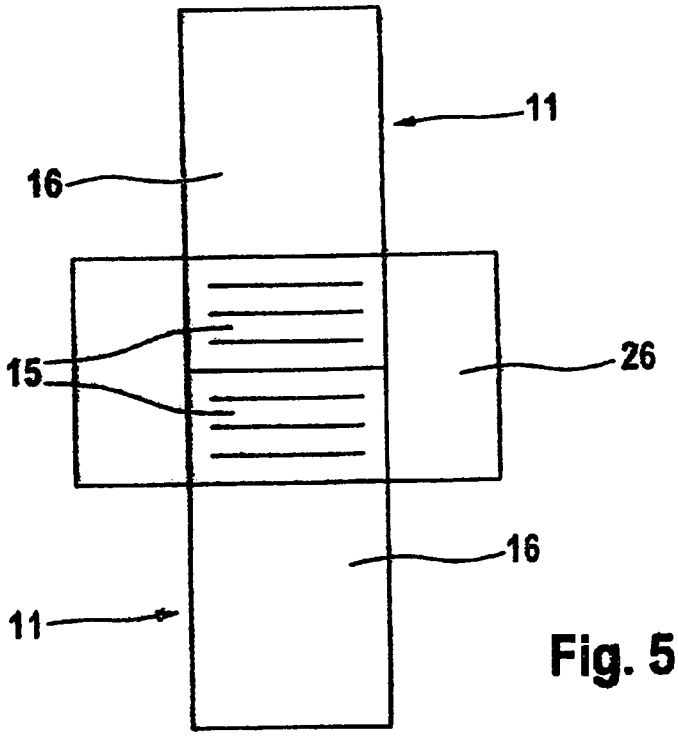
FIG. 5 shows a view onto the apparatus of FIG. 4 in the view direction V according to FIG. 4.

In the example embodiment of FIGS. 4 and 5, the inventive apparatus 23 has a revolver-like rotatable carrier 27, which is rotatable about an axis 29 in the sense of the arrow 28. A plurality of rotatable plates or turntables 30 for receiving gas turbine blades 11 are arranged distributed over the circumference of the carrier 27. All turntables 30 are, on the one hand, rotatable in common about the axis 29 in the direction of the arrow 28, and on the other hand, each one of the turntables 30 is individually rotatable in the sense of an arrow 31, namely then when the corresponding turntable 30 is located in the area of the processing chamber 26 and therewith of the ultrasonic sonotrode 24 for the processing of the gas turbine blades 11 positioned on the turntable 30. Accordingly, by the rotating of the revolver-like carrier 27 in the sense of the arrow 28, always one turntable 30 together with the gas turbine blades 11 positioned on the turntable 30 can be move into the processing station 26 or moved out of the same. During the processing of two gas turbine blades within the processing station 26, the corresponding turntable 30 is rotatable in the sense of the arrow 31, in order to thereby ensure a uniform blasting of all support surfaces of the blade roots 15 of the gas turbine blades 11.

It is common to all example embodiments, that for the ultrasonic shot peening of gas turbine blades 11 in the area of their blade roots 15, these are oriented in such a manner relative to an oscillating surface 13 of an ultrasonic sonotrode 12 that extends essentially in the horizontal direction, so that the support surfaces of the blade roots 15, that are to be blasted and that are especially fir tree profiled or dovetail profiled, are oriented parallel to the oscillating surface 13. Thus, the gas turbine blades 11 are not oriented standing within the processing chamber, but rather lying with a horizontally extending longitudinal axis, which extends between the radially inwardly lying end of the blade root and the radially outwardly lying end of the blade vane of the gas turbine blades. The gas turbine blades are rotatable about this longitudinal axis during the shot peening.

In the illustrated example embodiments, the inventive apparatuses always encompass only one sonotrode, which is arranged below the processing chamber. It is noted, that of course also several sonotrodes can be arranged in the area of a processing chamber 26, whereby then preferably one sonotrode or rather one oscillating surface of the sonotrodes is arranged below and another one is arranged above the processing chamber.

With the present invention, an optimized hardening depth as well as an increased compressive residual stress is achievable during the ultrasonic shot peening in comparison to the state of the art. This is achieved by the inventive orientation of the blade roots during the ultrasonic shot peening. The quality of the blasted surface can be further improved by a rotating or turning of the blade roots during the ultrasonic shot peening.

The invention claimed is:

1. Method for surface blasting a blade root of a gas turbine blade, comprising steps wherein shot balls are accelerated with an oscillating surface of a vibrator and are directed onto a profiled support surface of the blade root of the gas turbine blade, in order to perform the surface blasting, and wherein the gas turbine blade is oriented so that during the surface blasting the profiled support surface extends at least temporarily essentially parallel to the oscillating surface of the vibrator.

2. Method according to claim 1, characterized in that the vibrator is positioned so that the oscillating surface of the vibrator extends essentially in a horizontal direction.

3. Method according to claim 1, characterized in that the gas turbine blade is oriented so that during the surface blasting a tangent to protrusions of the profiled support surface extends at least temporarily essentially parallel to the oscillating surface of the vibrator.

4. Method according to claim 1, characterized in that the gas turbine blade is oriented so that during the surface blasting a blade axis extending from an end of the blade root toward an opposite end of a blade vane of the gas turbine blade extends at least temporarily essentially parallel to the oscillating surface of the vibrator.

5. Method according to claim 4, characterized in that the gas turbine blade is rotated about the blade axis at least temporarily during the surface blasting.

6. Method according to claim 1, characterized in that the gas turbine blade is rotated about an axis extending essentially parallel to the oscillating surface of the vibrator.

7. Method according to claim 1, wherein the vibrator comprises an ultrasonic sonotrode, and the surface blasting comprises ultrasonic shot peening.

8. Method according to claim 1, wherein the profiled support surface of the gas turbine blade is a fir tree profiled support surface or a dovetail profiled support surface.

9. Apparatus for surface blasting a blade root of a gas turbine blade, comprising a vibrator having an oscillating surface that extends essentially horizontally, a processing chamber that is adapted to receive the blade root in a chamber space thereof adjoining the oscillating surface, and that comprises plural covers bounding the chamber space, wherein at least one of the covers has at least one recess or opening permitting inward and outward movement of the blade root, and a blade carrier arrangement adapted for movement and positioning of the gas turbine blade with which the gas turbine blade is orientable so that during the surface blasting a profiled support surface of the blade root extends at least temporarily essentially parallel to the oscillating surface of the vibrator.

10. Apparatus according to claim 9, characterized in that the processing chamber is embodied so that the gas turbine blade is orientable so that a blade axis extending from an end of the blade root toward an opposite end of a blade vane of the gas turbine blade extends essentially parallel to the oscillating surface of the vibrator.

11. Apparatus according to claim 9, characterized in that the blade carrier arrangement is embodied so that the gas turbine blade is rotatable within the processing chamber about an axis extending essentially parallel to the oscillating surface.

12. Apparatus according to claim 9, wherein said blade carrier arrangement comprises a rotatable carrier adapted to carry the gas turbine blade and at least one additional gas turbine blade around a circumference of the rotatable carrier, and wherein at least one of the gas turbine blades respectively can be brought into the processing chamber or removed therefrom by rotating the rotatable carrier.

13. Apparatus according to claim 12, characterized in that the rotatable carrier (27) comprises several turntables that are spaced apart from one another in a circumferential direction and that are embodied for receiving the gas turbine blades.

14. Apparatus according to claim 13, characterized in that each turntable is respectively rotatable about an individual turntable axis, and in that all of the turntables are rotatable together in common about an axis of the rotatable carrier (27).

15. Apparatus according to claim 13, wherein each one of the turntables is respectively embodied to carry respectively two of the gas turbine blades.

16. Apparatus according to claim 11, wherein the axis extending essentially parallel to the oscillating surface is a blade axis extending from an end of the blade root toward an opposite end of a blade vane of the gas turbine blade.

17. Apparatus according to claim 9, wherein the vibrator comprises an ultrasonic sonotrode, and the surface blasting comprises ultrasonic shot peening.

18. A method of surface blasting a blade root of a gas turbine blade, wherein the blade root includes a profiled support surface that is to be surface blasted, and wherein the method comprises:

a) providing a vibrator having an oscillatory surface;

b) providing shot balls;

c) vibrating the oscillatory surface and, with the vibrating oscillatory surface, accelerating the shot balls to impact onto the profiled support surface so as to perform the surface blasting; and d) orienting the gas turbine blade relative to the vibrator so that the profiled support surface extends essentially parallel to the oscillatory surface at least temporarily during the surface blasting.

* * * * *